US012800237B2

(12) United States Patent
Lee et al.

(10) Patent No.: US 12,800,237 B2
(45) Date of Patent: Nov. 17, 2026

(54) HEAT EXCHANGER

(71) Applicant: LG ELECTRONICS INC., Seoul (KR)

(72) Inventors: Sangyeul Lee, Seoul (KR); Sukyoung Lee, Seoul (KR); Jaeyoung Kim, Seoul (KR); Eungyul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 232 days.

(21) Appl. No.: 18/414,073

(22) Filed: Jan. 16, 2024

(65) Prior Publication Data

US 2024/0247879 A1 Jul. 25, 2024

(30) Foreign Application Priority Data

Jan. 19, 2023 (KR) ..... 10-2023-0008146

(51) Int. Cl.

| | |
|---|---|
| ***F28F 1/12*** | (2006.01) |
| ***F28F 1/30*** | (2006.01) |
| *F28F 1/10* | (2006.01) |
| *F28F 1/22* | (2006.01) |

(52) U.S. Cl.

CPC ..... *F28F 1/128* (2013.01); *F28F 1/30* (2013.01); *F28F 1/10* (2013.01); *F28F 1/105* (2013.01); *F28F 1/12* (2013.01); *F28F 1/22* (2013.01); *F28F 2215/08* (2013.01)

(58) Field of Classification Search

CPC ..... F28F 1/128; F28F 1/30; F28F 1/10; F28F 1/105; F28F 1/12; F28F 1/22

See application file for complete search history.

(56) References Cited

U.S. PATENT DOCUMENTS

2004/0251016 A1* 12/2004 Oh ..... F28F 1/32 165/172

2009/0014159 A1 1/2009 Nishino et al.

FOREIGN PATENT DOCUMENTS

| | | | |
|---|---|---|---|
| CN | 102109289 | A | 6/2011 |
| JP | 58-128385 | U | 8/1983 |
| KR | 10-2020-0043897 | A | 4/2020 |
| KR | 10-2022-0101401 | A | 7/2022 |

* cited by examiner

*Primary Examiner* — Joel M Attey

(74) *Attorney, Agent, or Firm* — Birch, Stewart, Kolasch & Birch, LLP

(57) ABSTRACT

A heat exchanger includes a heat transfer tube configured to guide a refrigerant, and a plurality of fins each having a through-hole through which the heat transfer tube is vertically installed, the plurality of fins being spaced apart from each other to allow air to pass in a first direction. Each of the plurality of fins includes a corrugated portion formed in a zigzag shape in the first direction, a sheet portion surrounding the through-hole and a connecting portion connecting the sheet portion and the corrugated portion, wherein an inclined contact point, which is the highest position of the connecting portion and the corrugated portion, is located lower than a valley portion contact point, which is the lowest position of the connecting portion and the corrugated portion, in a second direction perpendicular to the first direction.

19 Claims, 6 Drawing Sheets

HEAT EXCHANGER

CROSS-REFERENCE TO RELATED APPLICATION

This application claims the priority benefit of Korean Patent Application No. 10-2023-0008146 filed on Jan. 19, 2023, in the Republic of Korea, which is hereby incorporated by reference in its entirety for all purposes as if fully set forth herein.

BACKGROUND OF THE DISCLOSURE

Technical Field

The present disclosure relates to a heat exchanger with high heat exchange efficiency and low air flow resistance.

Description of the Related Art

In general, a heat exchanger can be used as a condenser or an evaporator in a refrigeration cycle device consisting of a compressor, a condenser, an expansion mechanism, and an evaporator.

Such a heat exchanger can be installed in a vehicle, a refrigerator, and the like to exchange heat between refrigerant and air.

Heat exchangers can be classified into a finned tube type heat exchanger, a micro-channel type heat exchanger, etc.

Recently, a corrugated fin formed by being bent into a corrugated shape has been widely used, and a heat exchanger with improved performance by employing such a corrugated fin to achieve more efficient heat exchange between refrigerant and air has been disclosed.

Korean Laid-Open Patent Publication No. 2019-0115907, which is hereby incorporated by reference, discloses a plate fin for improving the heat transfer rate on the fin side without an increase in pressure loss on the air side. The plate fin is configured such a plurality of ridge portions are formed along a column direction and a sheet portion around a through-hole is formed in an oval shape elongated horizontally.

In that publication, as the fin has a horizontally elongated shape, more air may come into contact with the periphery of a collar portion to thereby increase the heat transfer efficiency.

However, when the sheet portion is formed in the same direction as the air flow direction, air stagnation occurs.

In order to address this, U.S. Laid-Open Patent Publication No. 2009-0014159, which is hereby incorporated by reference, discloses a fin defining a vortex generator winglet to prevent the stagnation of air.

However, such a vortex generator winglet is a physical structure in which winglets on the rear side of the fin are oriented in the same direction, which causes a decrease in rigidity and the frost formation.

In addition, Chinese Patent Application No. 10-2109289, which is hereby incorporated by reference, discloses a rectangular-shaped vortex generator provided at a flange on the rear side of a hole to form a vertical vortex. Accordingly, heat exchange is performed between a cold fluid and a hot fluid.

However, such a vortex generator is also a physical structure, which requires cost and space for the structure formation and causes a decrease in rigidity.

Patent Document 1—Korean Laid-Open Patent Publication No. 2019-0115907 (published on Apr. 28, 2020).

Patent Document 2—U.S. Laid-Open Patent Publication No. 2009-0014159 (published on Jan. 15, 2009).

Patent Document 3—Chinese Patent Application No. 10-2109289 (published on Jun. 29, 2011).

SUMMARY OF THE DISCLOSURE

It is an objective of the present disclosure to provide a heat exchanger that is easy to manufacture, has high heat exchange efficiency, and has low air flow resistance.

It is another objective of the present disclosure to provide a heat exchanger including a through-hole through which a heat transfer tube passes, a corrugated portion formed in a zigzag shape in a first direction corresponding to an air flow direction, and a sheet portion configured as a flat surface adjacent to the through-hole, thereby facilitating the mixing of air in a region adjacent to the corrugated portion and the through-hole.

It is yet another objective of the present disclosure to facilitate the upward and downward movement of air while employing a corrugated fin without a louver, thereby achieving the heat exchange performance with low fin per inch (FPI).

It is yet another objective of the present disclosure to provide an optimized size that can reduce an air stagnation region in a rear space of a heat transfer tube by optimizing the structure between a corrugated portion and a sheet portion of a corrugated fin.

The objectives of the present disclosure are not limited to the objectives described above, and other objectives not stated herein will be clearly understood by those skilled in the art from the following description.

According to one aspect of the subject matter described in this application, a heat exchanger includes: a heat transfer tube configured to guide a refrigerant: and a plurality of fins each having a through-hole through which the heat transfer tube is installed, the plurality of fins being spaced apart from each other to allow air to pass in a first direction. Each of the plurality of fins includes: a corrugated portion formed in a zigzag shape in the first direction: a sheet portion disposed to surround the through-hole: and a connecting portion configured to connect the sheet portion and the corrugated portion. An inclined contact point, which is the highest position of the connecting portion and the corrugated portion, is located lower than a valley portion contact point, which is the lowest position of the connecting portion and the corrugated portion in a second direction perpendicular to the first direction.

Each of the plurality of fins may further include a collar in surface contact with the heat transfer tube. The sheet portion may be connected to an outer surface of the collar.

The through-hole may be configured as a circle having a radius of a first size from a center of the heat transfer tube.

The sheet portion may be formed in a donut shape that is concentric with the through-hole and has a radius of a second size greater than the first size.

The connecting portion may have an inclined surface that extends from the corrugated portion to a boundary line of the sheet portion having the radius of the second size.

The corrugated portion may include a plurality of inclined portions having an inclination with respect to the first direction.

The corrugated portion may include four inclined portions, two ridge portions, and one valley portion with respect to one sheet portion.

The through-hole may have a center that is located to overlap the valley portion in the second direction.

A position of an inclined contact point where each of the two ridge portions and the connecting portion meet satisfy a position condition that is less than the second size with respect to the second direction.

An inclination angle between the connecting portion and the sheet portion with respect to the inclined contact point may be less than or equal to a threshold value so as to satisfy an angle condition.

The two ridge portions may be located higher than or equal to the sheet portion in a third direction that is perpendicular to the first direction and the second direction.

According to another aspect, an air conditioner includes: an indoor heat exchanger configured to exchange heat with indoor air: and an outdoor heat exchanger configured to exchange heat with outdoor air. At least one of the indoor heat exchanger and the outdoor heat exchanger includes: a heat transfer tube configured to guide a refrigerant: and a plurality of fins each having a through-hole through which the heat transfer tube is vertically installed, the plurality of fins being spaced apart from each other to allow air to pass in a first direction. Each of the plurality of fins includes: a corrugated portion formed in a zigzag shape in the first direction: a sheet portion disposed to surround the through-hole: and a connecting portion configured to connect the sheet portion and the corrugated portion. An inclined contact point, which is the highest position of the connecting portion and the corrugated portion, is located lower than a valley portion contact point, which is the lowest position of the connecting portion and the corrugated portion in a second direction perpendicular to the first direction.

A separation distance may be defined between the plurality of fins.

Each of the plurality of fins may further include a collar in surface contact with the heat transfer tube. The sheet portion may be connected to an outer surface of the collar.

The through-hole may be configured as a circle having a radius of a first size from a center of the heat transfer tube.

The sheet portion may be formed in a donut shape that is concentric with the through-hole and has a radius of a second size greater than the first size.

The connecting portion may have an inclined surface that extends from the corrugated portion to a boundary line of the sheet portion having the radius of the second size.

The corrugated portion may include a plurality of inclined portions having an inclination with respect to the first direction.

The corrugated portion may include four inclined portions, two ridge portions, and one valley portion with respect to one sheet portion.

A position of an inclined contact point where each of the two ridge portions and the connecting portion meet satisfy a position condition that is less than the second size with respect to the second direction, and an inclination angle between the connecting portion and the sheet portion with respect to the inclined contact point may be less than or equal to a threshold value so as to satisfy an angle condition.

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

Figure 7:
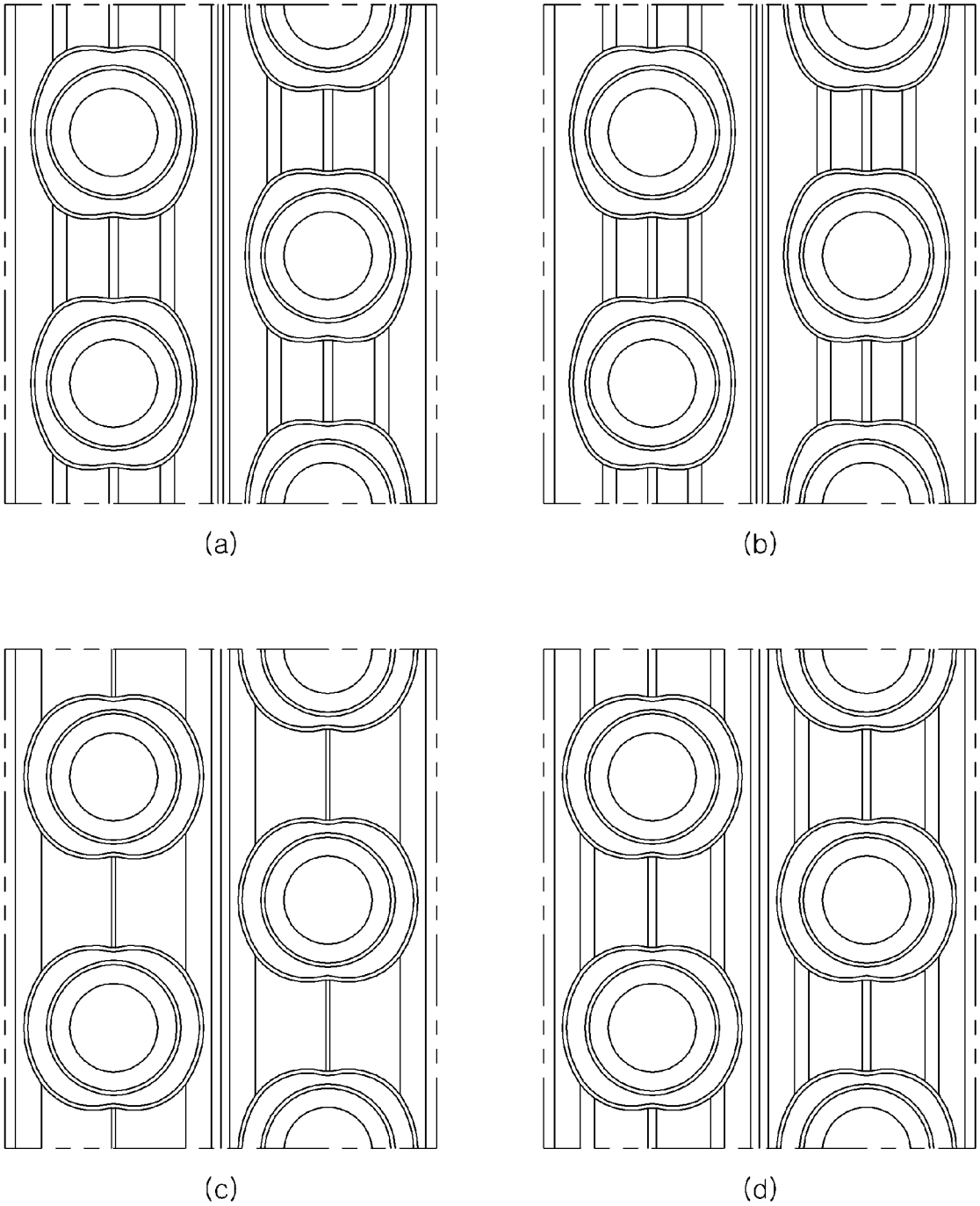

(a) to (d) of FIG. 7 illustrate various experiment examples of the present disclosure.

Figure 8A:
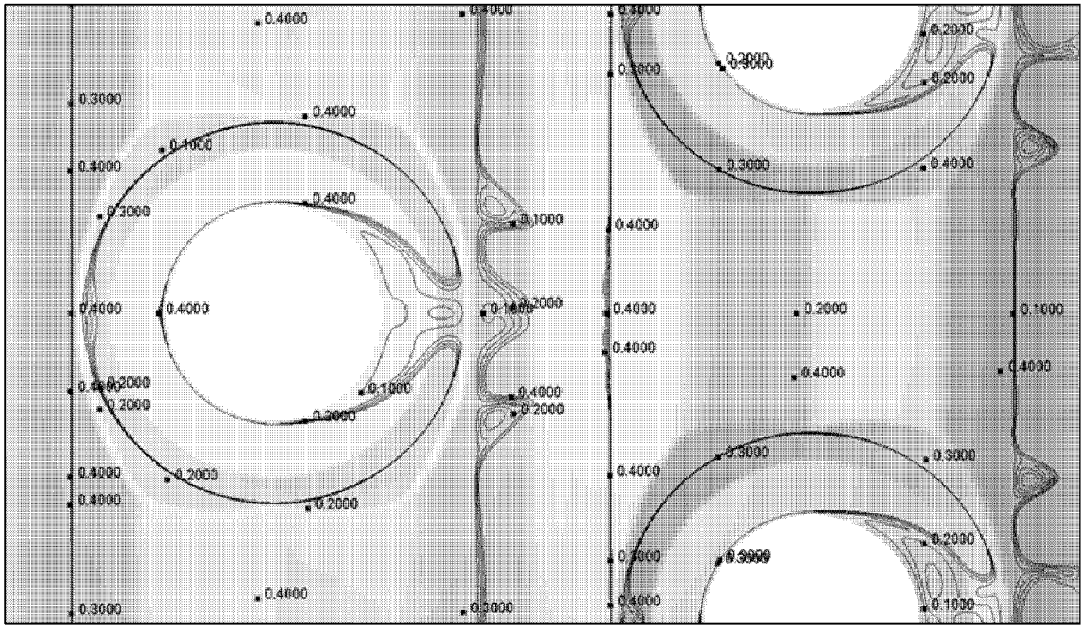
Figure 8B:
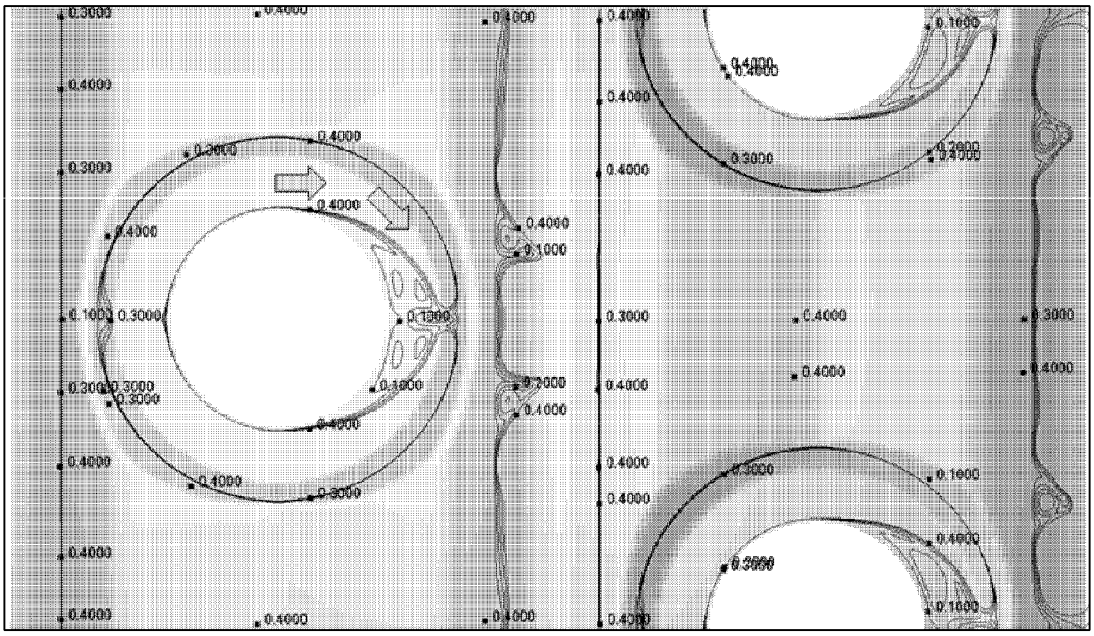

FIG. 8A shows a photo of the flow velocity for Experiment Example 1, and FIG. 8B shows a photo of the flow velocity for an embodiment of the present disclosure.

Figure 9:
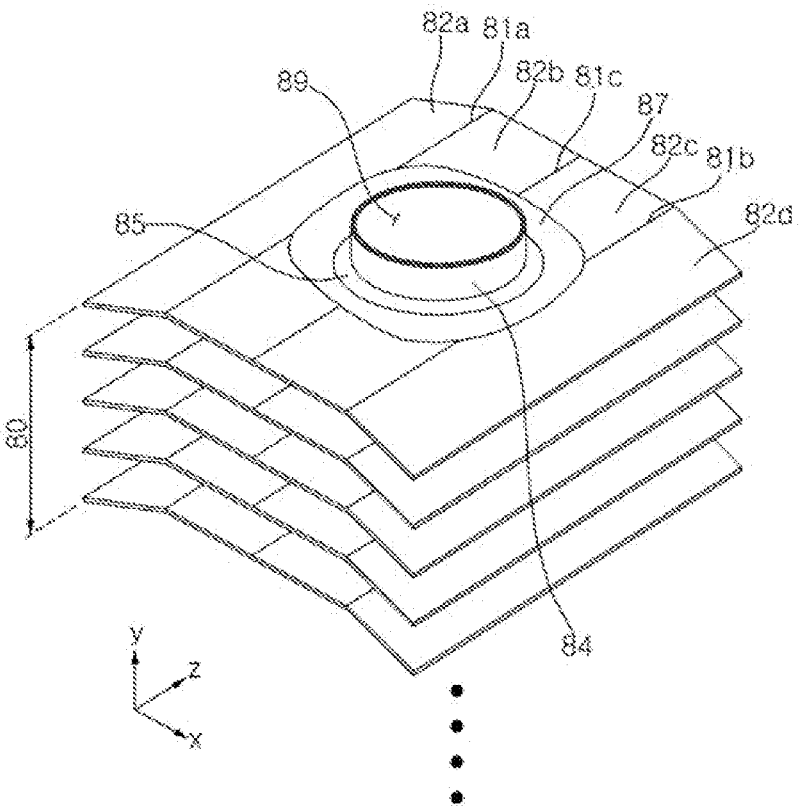

FIG. 9 illustrates a heat exchanger with the fins of FIGS. 2 to 6 superimposed over one another.

DETAILED DESCRIPTION

The present invention will now be described with reference to the accompanying drawings, wherein the same reference numerals have been used to identify the same or similar elements throughout the several views.

The above and other aspects, features and other advantages of the present disclosure will be more clearly understood from the following detailed description taken in conjunction with the accompanying drawings. Exemplary embodiments will now be described more fully hereinafter with reference to the accompanying drawings: however, they may be embodied in many different forms and should not be construed as limited to the embodiments set forth herein. Rather, these embodiments are provided so that this disclosure will be thorough and complete, and will fully convey the scope of the exemplary embodiments to those skilled in the art. The same reference numerals are used throughout the drawings to designate the same or similar components.

Spatially relative terms such as "below", "beneath", "lower", "above", "upper", etc., can be used to easily describe the correlation between one component and another component as shown in the drawing. Spatially relative terms should be understood as including different directions of components at the time of use or operation in addition to the directions shown in the drawing. For example, when reversing a spherical element shown in the drawing, a component described as "below" or "beneath" of another component may be placed "above" another component. Thus, the illustrative term "below" may include both the lower and the above directions. Components can also be oriented in different directions, so that spatially relative terms can be interpreted according to the orientation. In addition, the term "may" is interchangeable with the term "can" for purposes of this specification.

The terms herein are merely used to describe various embodiments of the present disclosure but are not intended to limit the present disclosure. Singular forms are intended to include plural forms unless the context clearly indicates otherwise. The terms "comprise" and/or "comprising" used in this specification do not exclude presence or addition of one or more other constituents, steps and/or operations in addition to the stated constituent, step, and/or operation.

Unless otherwise defined herein, all terms (including scientific and technical terms) used in the present specification may have meanings commonly understood by those skilled in the art. Such terms as those defined in a generally used dictionary are to be interpreted to have the same meanings as the contextual meanings in the relevant field of art, and are not to be interpreted to have ideal or excessively formal meanings unless clearly defined in the present disclosure.

In the drawings, the thickness or size of each constituent is exaggerated, omitted, or schematically illustrated for ease description and clarity. In addition, the size or area of each constituent does not completely reflect the real size or area thereof.

For simplicity and clarity of illustration, elements in the drawings are not necessarily drawn to scale. The same reference numbers in different drawings represent the same or similar elements, and as such perform similar functionality. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure. Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

In addition, angles and directions referred in description of structures of embodiments are based on the illustrations of the drawings. In the case that a reference point or a reference position for an angle is not clearly stated in description of structures forming the embodiments, refer to the relevant drawings.

Hereinafter, the present disclosure will be described in detail with reference to the accompanying drawings.

Figure 1:
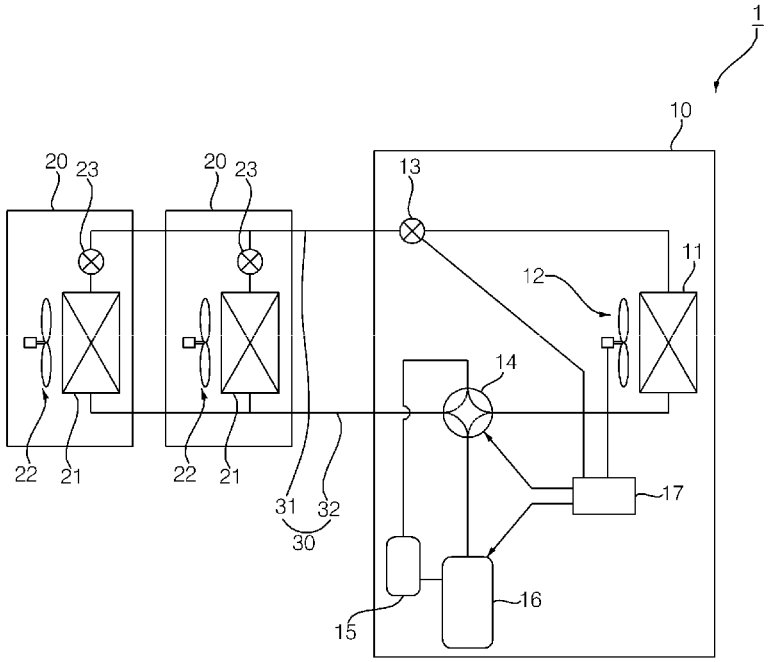
FIG. 1 is a schematic diagram of an air conditioner according to an embodiment of the present disclosure.

FIG. 1 is a schematic diagram of an air conditioner in heating operation, according to an embodiment of the present disclosure.

As shown in FIG. 1, an air conditioner 1 includes an outdoor unit 10 that is provided in an outdoor space, a plurality of indoor units 20 that are provided in an indoor space, and refrigerant pipes 31 and 32 that connect the outdoor unit 10 and the plurality of indoor units 20 to allow a refrigerant to circulate between the outdoor unit 10 and the plurality of indoor units 20.

In this embodiment, two indoor units 20 are connected to one outdoor unit 10. However, this is merely an example, and the present disclosure is not limited thereto. That is, one indoor unit 20 may be connected to one outdoor unit 10, or three or more indoor units 20 may be connected to one outdoor unit 10.

The outdoor unit 10 includes an outdoor heat exchanger 11 configured to exchange heat between outdoor air and a refrigerant, an outdoor blower 12 configured to allow the outdoor air to pass through the outdoor heat exchanger 11, a compressor 16 configured to compress a refrigerant, a four-way valve 14 configured to guide the refrigerant discharged from the compressor 16 to one of the outdoor unit 10 and the indoor units 20, an outdoor expansion valve 13 configured to decompress and expand the refrigerant, and an accumulator 15 configured to separate a liquid refrigerant from the refrigerant introduced into the compressor 16 to allow the liquid refrigerant to be vaporized and introduced into the compressor 16.

The outdoor unit 10 also includes a controller 17 to control the operation of the outdoor blower 12, the outdoor expansion valve 13, the compressor 16, and the four-way valve 14. The controller 17 may be configured as a microcomputer or the like.

The indoor unit 20 includes an indoor heat exchanger 21 configured to exchange heat between indoor air and a refrigerant, an indoor blower 22 configured to allow the indoor air to pass through the indoor heat exchanger 21, and an indoor expansion valve 23 configured to decompress and expand the refrigerant.

A refrigerant pipe 30 includes a liquid refrigerant pipe 31 through which a liquid refrigerant passes, and a gaseous refrigerant pipe 32 through which a gaseous refrigerant passes. The liquid refrigerant pipe 31 allows the refrigerant to flow between the indoor expansion valve 23 and the outdoor expansion valve 13.

The gaseous refrigerant pipe 32 guides the refrigerant to flow between the four-way valve 14 of the outdoor unit 10 and the gas side of the indoor heat exchanger 21 of the indoor unit 20.

Any one of HC refrigerant, HC mixed refrigerant, R32, R410A, R407C, and carbon dioxide may preferably be used as a refrigerant in the air conditioner, however, any known type of refrigerant may be used.

Figure 2:
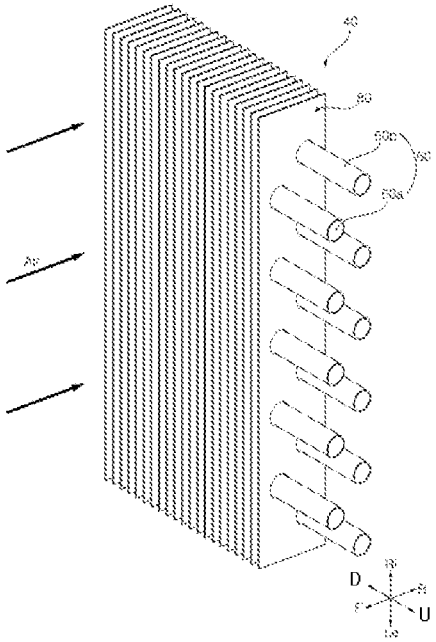
FIG. 2 is a perspective view of a heat exchanger according to an embodiment of the present disclosure.
Figure 3:
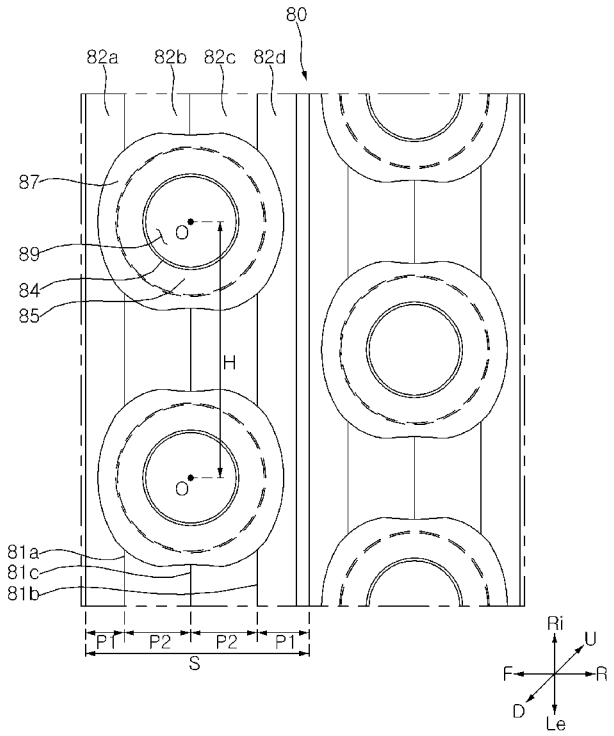
FIG. 3 is an enlarged plan view showing a portion of a fin according to an embodiment of the present disclosure.

FIG. 2 is a perspective view of a heat exchanger according to an embodiment of the present disclosure, and FIG. 3 is an enlarged plan view showing a portion of a fin according to an embodiment of the present disclosure.

Referring to FIGS. 2 and 3, a heat exchanger 40 corresponds to at least one of the outdoor heat exchanger 11 and the indoor heat exchanger 21 shown in FIG. 1.

The heat exchanger 40, which is a fin-tube type heat exchanger, includes a plurality of fins 80 formed of an aluminum material and a heat transfer tube 60 having a circular cross section formed of a copper or aluminum material or any other metal.

The heat transfer tube 60 is provided in plurality, and the plurality of heat transfer tubes 60 extend in an up-down direction (e.g., third direction) (UD) that is perpendicular to an air flow direction. In detail, the heat transfer tube 60 may include a plurality of first column heat transfer tubes 60*a* that are spaced apart from one another in a left-right direction (e.g., second direction) (Le-Ri), and a plurality of second column heat transfer tubes 60*b* that are spaced rearward from the first column heat transfer tubes 60*a* and spaced apart from one another in the left-right direction.

A pitch between the first column heat transfer tubes 60*a* is the same as a pitch between the second column heat transfer tubes 60*b*, and the first column heat transfer tubes 60*a* and the second column heat transfer tubes 60*b* are arranged (e.g., are staggered) so as not to overlap each other in a front-rear direction. As the first column heat transfer tubes 60*a* and the second column heat transfer tubes 60*b* are arranged without overlapping each other in the front-rear direction, resistance exerted by the heat transfer tubes 60 on air flowing in the front-rear direction may be reduced.

The plurality of fins 80 are disposed perpendicular to the heat transfer tube 60 and are spaced apart from each other, so that air passes between the plurality of fins 80 in a first direction (e.g., front-rear direction) (FR). The heat transfer tube 60 is installed vertically through through-holes 89 provided in the respective fins 80 and arranged in parallel with each other. The heat transfer tube 60 is connected to the refrigerant pipes 30 of the air conditioner of FIG. 1 to thereby form a closed loop refrigeration cycle.

In addition, as the heat transfer tube 60 is in contact with the fin 80 to transfer or receive heat through the fin 80, a contact area with the air passing through the heat exchanger 40 via the fin 80 increases. Thus, heat exchange between the refrigerant passing through the heat transfer tube 60 and the refrigerant passing through the heat exchanger 40 is efficiently performed through the fin 80.

In order for more efficient heat transfer between the fin 80 and air, by using the press mold, the fin 80 is bent in a zigzag shape in the first direction (e.g., front-rear direction) corresponding to the air flow direction, allowing the fin 80 to have a corrugated form. In the following description, the fin 80 having the corrugated form may also be referred to as a corrugated fin 80.

The fin 80 includes a collar 84 in surface contact with the heat transfer tube 60, and a sheet portion 85 configured as a flat surface around the collar 84 to define the collar 84. As the sheet portion 85 is adjacent to the collar 84 in contact with the heat transfer tube 60, the sheet portion 85 has a temperature similar to that of the refrigerant passing through the heat transfer tube 60. The sheet portion 85 is connected to an outer surface of the collar 84.

The collar 84 protrudes from the sheet portion 85 in the up-down direction (U-D direction) and has a cylindrical shape.

As the collar 84 is formed in the cylindrical shape passing through the sheet portion 85, heat from the heat transfer tube 60 may be effectively transferred to the sheet portion 85 when coupled to the heat transfer tube 60.

Here, a height of the collar 84 protruding in an upward direction of the sheet portion 85 may be equal to or lower than a maximum height of a corrugated portion.

Accordingly, heat exchange between the refrigerant and the air can be efficiently achieved in the sheet portion 85, and thus, more air can come into contact with the sheet portion 85, allowing heat exchange efficiency of the heat exchanger 40 to be increased. The sheet portion 85 may be disposed to surround the through-hole 89.

The heat exchanger 40 according to an embodiment of the present disclosure provides a corrugated fin 80 capable of maintaining heat exchange efficiency while having relatively low fin per inch (FPI).

Thus, the number of corrugated fins 80 coupled per length of the heat transfer tube 60 may be significantly low, which corresponds to ½ to ⅓ of the general number of corrugated fins.

When the plurality of corrugated fins 80 constituting the heat exchanger 40 are penetrated by the same heat transfer tube 60, a separation distance between adjacent corrugated fins 80 may be greater than the height of the collar 84.

In other words, a portion or part of the heat transfer tube 60, which is not surrounded by the collar 84, is exposed to the outside, thereby requiring a smaller number of corrugated fins 80.

Figure 4:
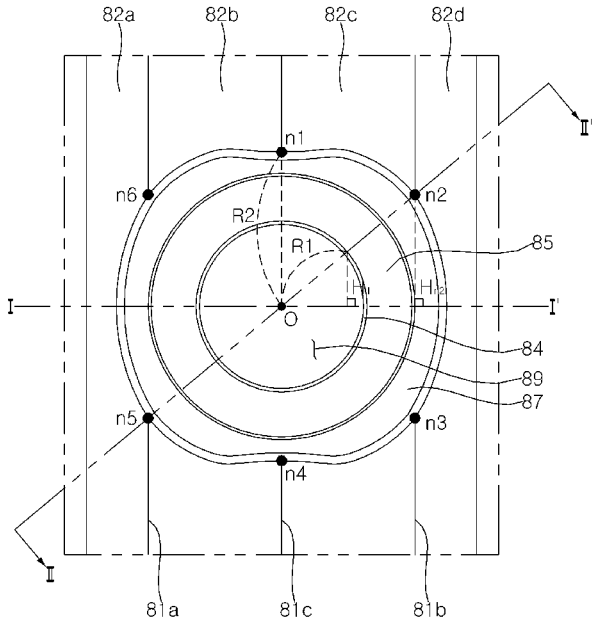
FIG. 4 is an enlarged plan view of one unit of the fin shown in FIG. 3.
Figure 5:
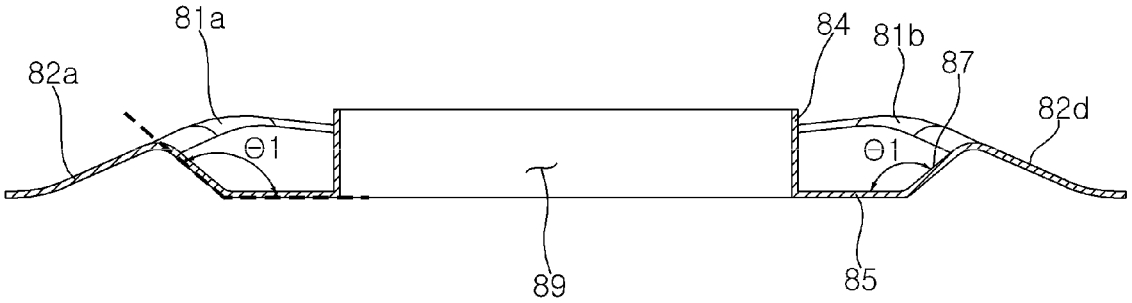
FIG. 5 is a cross-sectional view taken along line I-I' of the fin shown in FIG. 4.
Figure 6:
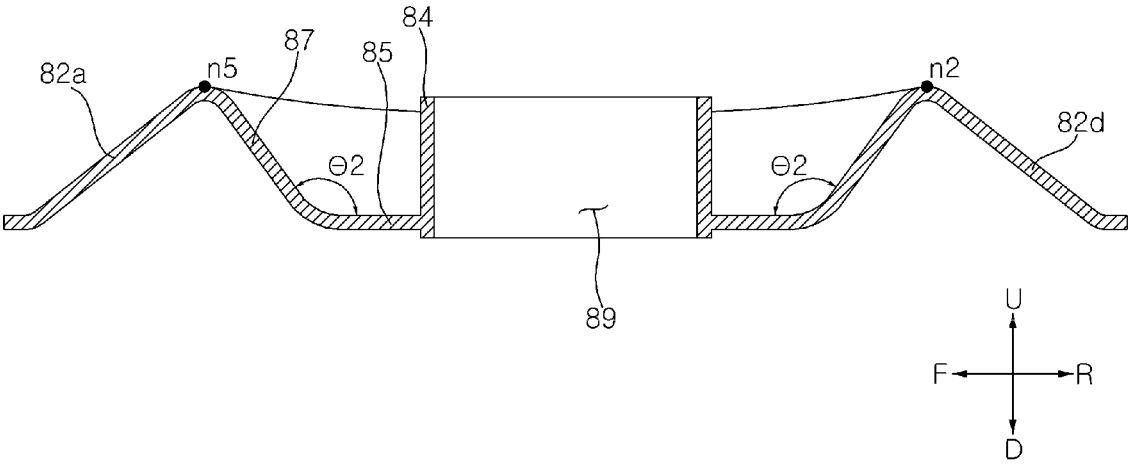
FIG. 6 is a cross-sectional view taken along line II-II' of the fin shown in FIG. 4.

By changing the structure of the corrugated fin 80, the heat exchanger 40 provides an optimized structure capable of maintaining the heat exchange efficiency with low FPI FIG. 4 is an enlarged plan view showing one unit of the fin in FIG. 3, FIG. 5 is a cross-sectional view taken along line I-I' of the fin shown in FIG. 4, and FIG. 6 is a cross-sectional view taken along line II-II' of the fin shown in FIG. 4.

Referring to FIGS. 3 to 6, the sheet portion 85 may define a surface that is parallel to the first direction around the through-hole 89. In detail, the sheet portion 85 may be defined as a surface that is parallel to the first direction (e.g., F-R direction) and the second direction (e.g., Ri-Le direction) around the through-hole 89.

The through-hole 89 is configured as a circular opening having a radius of R1 from a center O of the heat transfer tube 60.

The sheet portion 85 has the shape of a circle that has a center coinciding with the center O of the heat transfer tube 60 and has a radius of R2, which is greater than R1 in a plane defined by the first direction (F-R direction) and the second direction (Ri-Le direction) perpendicular to the first direction. Accordingly, the area occupied by the sheet portion 85 has a donut shape, and a boundary line of the sheet portion 85 and the through-hole 89 form concentric circles.

Here, the circle is of a substantially circular shape with the radius of a second length in the first direction, and the boundary line is not entirely curved. Some sections of the boundary line may be connected while forming a straight line.

As the sheet portion 85 is provided on the same plane with respect to the air flow direction, heat exchange can be performed between the refrigerant in the heat transfer tube 60 penetrating the sheet portion 85 and air. Accordingly, the sheet portion 85 and a corrugated portion between two adjacent sheet portions 85 have a corrugated form to allow more air to be exchanged and mixed, thereby increasing heat exchange efficiency of the heat exchanger 40.

That is, the corrugated fin 80 includes a corrugated portion. The corrugated portion is a region formed in a zigzag shape proceeding or extending in the first direction corresponding to the air flow direction. The corrugated portion is positioned between adjacent sheet portions 85.

The corrugated portion includes four inclined portions 82*a*, 82*b*, 82*c*, and 82*d*, two ridge portions 81*a* and 81*b*, and one valley portion 81*c*, the two ridge portions 81*a* and 81*b* and the one valley portion 81*c* being defined by the four inclined portions 82*a*, 82*b*, 82*c*, and 82*d*.

The ridge portions 81*a* and 81*b* include a first ridge portion 81*a* that is located relatively forward and a second ridge portion 81*b* that is located rearward relative to the first ridge portion 81*a*, and the valley portion 81*c* is located between the first ridge portion 81*a* and the second ridge portion 81*b*.

The four inclined portions 82*a*, 82*b*, 82*c*, and 82*d* have an inclination with respect to the first direction (F-R direction) and extend in the second direction (Ri-Le direction).

In detail, the inclined portions 82*a*, 82*b*, 82*c*, and 82*d* may include a first inclined portion 82*a* that is connected to the front of the first ridge portion 81*a*, a second inclined portion 82*b* that is connected to the rear of the first ridge portion 81*a* and provides a connection between the first ridge portion 81*a* and the valley portion 81*c*, a third inclined portion 82*c* that is connected to the front of the second ridge portion 81*b* and provides a connection between the second ridge portion 81*b* and the valley portion 81*c*, and a fourth inclined portion 82*d* that is connected to the rear of the second ridge portion 81*b*.

Here, the ridge portions 81*a* and 81*b* and the valley portion 81*c* correspond to folded parts generated when the corrugated fin 80 is bent to form the inclined portions 82*a*, 82*b*, 82*c* and 82*d*, and the inclined portions 82*a*, 82*b*, 82*c*, and 82*d* are inclined surfaces inclined with respect to a surface of the fin 80 before the formation of the inclined portions 82*a*, 82*b*, 82*c*, and 82*d*.

Therefore, the fin 80 includes the ridge portions 81*a* and 81*b*, the valley portion 81*c*, and the inclined portions 82*a*, 82*b*, 82*c*, and 82*d* connected to each other in a zigzag shape by the ridge portions 81*a* and 81*b* and the valley portion 81*c*. The corrugated portion having the zigzag shape is formed by the ridge portions 81*a* and 81*b*, the valley portion 81*c*, and the inclined portions 82*a*, 82*b*, 82*c*, and 82*d*.

The second inclined portion 82*b* may decrease in width in the second direction from front to rear, and the third inclined portion 82*c* may increase in width in the second direction from front to rear.

Here, a length P2 of the first inclined portion 82*a* may correspond to 55 to 90% of a length P1 of the second inclined portion 82*b*, and may preferably correspond to 58 to 88% of the length P1 of the second inclined portion 82*b*.

This may be equally applied to the case of the fourth inclined portion 82*d* and the third inclined portion 82*c*.

That is, as the length P1 of an inner side region is secured, a depressed portion having a length in the first direction, which is the same as the sum (P1+P1) of the lengths of the second and third inclined portions 82*b* and 82*c*, is formed to extend to the sheet portion 85.

Accordingly, the area of the sheet portion 85 is disposed in the second and third inclined portions and does not protrude outside the second and third inclined portions.

The first ridge portion 81*a*, the second ridge portion 81*b*, and the valley portion 81*c* extend in the second direction. A center O of the through-hole 89 may be located to overlap the valley portion 81*c* in the second direction. The two ridge portions 81*a* and 81*b* may be disposed so as not to overlap the through-hole 89 in the second direction.

The two ridge portions 81*a* and 81*b* may be disposed so as not to overlap the sheet portion 85 in the second direction. The sheet portion 85 is positioned between the two ridge portions 81*a* and 81*b*.

As the sheet portion 85 has various shapes within the sum (P1+P1) of the lengths of the second and third inclined portions 82*b* and 82*c*, the heat exchange efficiency can be increased.

Due to this interaction of the sheet portion 85 with the valley portion 81*c* and the ridge portions 81*a* and 81*b*, air can be uniformly mixed in the second direction.

The two ridge portions 81*a* and 81*b* are located higher than the sheet portion 85 in the third direction (e.g., up-down direction). In addition, the valley portion 81*c* is located higher than the sheet portion 85 in the third direction. The two ridge portions 81*a* and 81*b* are located higher than or equal to an upper end (or top) of the collar 84 in the third direction. In addition, the valley portion 81*c* is located lower than the upper end of the collar 84 in the third direction.

An inclination angle of the first inclined portion 82*a* with the first direction is equal to an inclination angle of the fourth inclined portion 82*d* with the first direction. An inclination angle of the second inclined portion 82*b* with the first direction is equal to an inclination angle of the third inclined portion 82*c* with the first direction.

The inclination angle of the first inclined portion 82*a* with the first direction and the inclination angle of the fourth inclined portion 82*d* with the first direction may be greater than the inclination angle of the second inclined portion 82*b* with the first direction and the inclination angle of the third inclined portion 82*c* with the first direction.

The inclination angle of the first inclined portion 82*a* with the first direction and the inclination angle of the fourth inclined portion 82*d* with the first direction may have a range of 30 to 45 degrees, and the inclination angle of the second inclined portion 82*b* with the first direction and the inclination angle of the third inclined portion 82*c* with the first direction may have a range of 7 to 20 degrees.

Preferably, the first ridge portion 81*a* and the second ridge portion 81*b* may be symmetric in the front-rear direction with respect to the valley portion 81*c*.

Here, a width of the fin 80 (hereinafter referred to as a "fin width") is denoted as S, and an interval between the heat transfer tubes 60 is denoted as H.

As described above, the sheet portion 85 has the shape of a circle with the radius of R2 from the center O of the heat transfer tube 60 in the first direction, which is the air flow direction.

Here, the center O of the heat transfer tube 60 is located at a position corresponding to the valley portion 81*c*.

The interval H between the heat transfer tubes 60 is defined as a distance from the center O of one heat transfer tube 60 to the center O of another (or next) heat transfer tube 60 in the first direction.

In this embodiment, the sheet portion 85 has a donut shape extending from the center O of the heat transfer tube 60 to the same distance.

In addition, each corrugated fin 80 includes a connecting portion 87 that connects the corrugated portion and the sheet portion 85. The connecting portion 87 is an inclined surface that connects between the ridge portions 81*a* and 81*b* and the valley portion 81 defining the corrugated portion, and the sheet portion 85. The connecting portion 87 is formed to surround the sheet portion 85.

Accordingly, condensed water generated in the heat exchanger 40 can be easily moved along the valley portion 81*c*, thereby preventing the condensed water from accumulating in the sheet portion 85. As a result, an increase in air resistance in the sheet portion 85 can be suppressed.

The valley portion 81*c* and the center of the ridge portions 81*a* and 81*b* may be disposed to overlap the center O of the heat transfer tube 60 in the front-rear direction.

Here, the connecting portion 87 may be divided into four quadrants.

A boundary line between the connecting portion 87 and the corrugated portion includes a plurality of inflection points.

As shown in FIG. 6, the boundary line between the connecting portion 87 and the corrugated portion may have an x-axis which is from the center O of the heat transfer tube 60 to the first direction, and a contact point with opposite valley portions 81*c* from the center O of the heat transfer tube 60 in the second direction may be defined as a vertical contact point n1, n4, and a contact point with the ridge portion 81*a*, 81*b* between horizontal and vertical contact points may be defined as an inclined contact point n2, n3, n5, n6.

Four contact points defining the inclined contact points n2, n3, n4, and n6 are located highest in the third direction.

The connecting portion 87 may include four partition surfaces formed in four quadrants defined by the first and second directions from the center O of the heat transfer tube 60, and the partition surfaces may have the same shape.

Here, each of the partition surfaces is configured such that a distance from the vertical contact point n1, n4 to the sheet portion 85 is the shortest, and a distance from the inclined contact point n2, n3, n5, n6 to the sheet portion 85 is the longest.

The connecting portion 87 may have an inclination with respect to the first direction and the third direction. In detail, an inclination angle between the connecting portion 87 and the first direction is determined by the position in contact with the corrugated portion.

In one example, when cutting along a line of the first direction that passes through the center O of the heat transfer tube 60, a junction point between the connecting portion 87 and the corrugated portion is located rearward relative to the ridge portion 81*a*, 81*b*, and accordingly, an angle between the connecting portion 87 and the sheet portion 85 that is formed along the line of the first direction passing through the center O of the heat transfer tube 60 defines a first angle θ1 as shown in FIG. 5.

In this case, the first angle θ1 has a left-right symmetric value with respect to the center O of the heat transfer tube 60.

Here, the first angle θ1 may be less than a first threshold value.

Meanwhile, the heat exchanger 40 according to an embodiment of the present disclosure is configured such that a point where the connecting portion 87 and the ridge portion meet at each fin 80 is fixed at a specific position so as to increase the heat exchange efficiency.

Here, the corresponding point is a contact point with each ridge portion 81*a*, 81*b*, and a total of four inclined contact points n2, n3, n5, and n6 are formed throughout the connecting portion 87.

The total of four inclined contact points n2, n3, n5, and n6 are arranged symmetrically with respect to the center O of the heat transfer tube 60. The inclined contact points n2, n3, n5, and n6 are located farther than the sheet portion 85 with respect to the center O of the heat transfer tube 60. The connecting portion 87 is disposed to surround the sheet portion 85.

When the center O of the heat transfer tube 60 is the center of coordinates, and the first and second directions are set to an x-axis and a y-axis, respectively, a y value Hn2 of the inclined contact point n2, n3, n5, n6, namely, a distance from the inclined contact point n2, n3, n5, n6 to the x-axis of the first direction passing through the center O of the heat transfer tube 60 satisfies a predetermined range.

Here, the y value Hn2 satisfies the following equation.

$$H1 \leq Hn2 \leq R2 \quad \text{[Equation 1]}$$

Here, when drawing an imaginary straight line from the center O of the heat transfer tube 60 to the inclined contact point (n2, n3, n5, n6), H1 is defined as a y value of a point on the through-hole 89 where the imaginary straight line passes.

In addition, R2 is defined as a radius of the sheet portion 85.

That is, unless the x-axis coincides with the imaginary straight line, the position of the second direction that defines the inclined contact point n2, n3, n5, n6 should naturally be higher than the height of the point on the through-hole 89.

Therefore, the inclined contact point n2, n3, n5, n6 is not located on the x-axis.

In addition, the imaginary straight line and the y-axis do not coincide with each other, and the position defining the inclined contact point n2, n3, n5, n6 has a y value lower than a valley portion contact point n1, n4, which is the bottom point of the connecting portion 87 and the valley portion 81*c*.

Thus, four inclined contact points n2, n3, n5, and n6 do not protrude further in the second direction than two valley portion contact points n1 and n4, and are disposed within the two valley portion contact points n1 and n4.

Due to this positioning of the inclined contact point n2, n3, n5, n6, the flow of air flowing over the sheet portion 85 by the connecting portion 87 becomes smooth without causing stagnation at a rear side of the heat transfer tube 60.

In addition, an inclination angle θ2 between the connecting portion 87 and the sheet portion 85 at the inclined contact point n2, n3, n5, n6 has a value less than a second threshold value.

The second threshold value satisfies 145 degrees, and an inclination angle of the inclined contact point n2, n3, n5, n6, which has the largest value of the inclination angle θ2 between the connecting portion 87 and the sheet portion 85, corresponds to 145 degrees or less, so that all points of the connecting portion 87 are 145 degrees or less.

The inclination angle θ2 allows the heat transfer performance to be increased.

In other words, as the positions of the inclined contact points n2, n3, n5, and n6, which are the highest points between the corrugated portion and the sheet portion 85, are specified while forming the sheet portion 85 in a donut shape based on a circle, compared to the related art, the thermoelectric efficiency can be increased while maintaining the flow rate without causing stagnation of the air flow.

FIGS. 7, 8A and 8B show comparative examples of the present disclosure.

(a)-(d) of FIG. 7 shows various experiment examples of the present disclosure, FIG. 8A is a photograph showing the flow velocity for Experiment Example 1, and FIG. 8B is a photograph showing the flow velocity for an embodiment of the present disclosure.

The shapes of fins in (a)-(c) of FIG. 7 correspond to comparative examples of the present disclosure, which respectively show examples in which a position condition and an angle condition are not satisfied.

(a) of FIG. 7 illustrates a case in which the position condition, e.g., ay value of the inclined contact point is greater than R2 without satisfying Equation 1, and an inclination angle of the inclined contact point, which is the angle condition, is greater than 145 degrees.

(b) of FIG. 7 illustrates a case in which the position condition, i.e., a y value of the inclined contact point is greater than R2 without satisfying Equation 1, but the angle condition is satisfied, namely, an inclination angle of the inclined contact point is less than 145 degrees.

(c) of FIG. 7 illustrates a case in which the position condition, i.e., a y value of the inclined contact point satisfies Equation 1 that is less than R2, and an inclination angle of the inclined contact point, which is the angle condition, is greater than 145 degrees.

(d) of FIG. 7 illustrates a case in which both the position condition and the angle condition of the present disclosure are satisfied.

The thermoelectric performance can be compared in the following table.

TABLE 1

| Fin type | Thermal performance | Position condition | Angle condition |
|---|---|---|---|
| (a) of FIG. 7 | 100% | Not satisfied | Not satisfied |
| (b) of FIG. 7 | 100.2% | Not satisfied | Satisfied |
| (c) of FIG. 7 | 100.9% | Satisfied | Not satisfied |
| (d) of FIG. 7 | 103.4% | Satisfied | Satisfied |

As shown in Table 1 above, (d) of FIG. 7 of the present disclosure exhibits a significant increase in thermal performance.

In addition, such an increase in heat exchange efficiency can be confirmed by detecting the flow velocity as shown in FIGS. 8A and 8B.

FIG. 8A shows the flow velocity detected on a fin as in the case of FIG. 7A that does not satisfy both the position and angle conditions, and FIG. 8B shows the flow velocity detected on a fin as in the embodiment of FIG. 7D of the present disclosure that satisfies both the position and angle conditions.

Referring to FIGS. 8A and 8B, it can be seen that the flow of air having a higher flow velocity is formed in the connecting portion and the sheet portion of FIG. 8B. In other words, the position of the inclined contact point facilitates a smooth flow of air to thereby prevent the saturation from occurring at the rear side of the collar, allowing the flow rate of air flowing through the sheet portion 85 to be increased and heat exchange with the heat transfer tube 60 to be facilitated.

As such, when the area occupied by the sheet portion 85 and the area occupied by the corrugated portion are designed to satisfy a predetermined ratio in a unit, although the number of fins 80 is small, the upward and downward flow of air can be facilitated to thereby achieve the heat exchange performance.

In addition, as no louver is provided in the corrugated portion of the present disclosure, it is possible to provide protection against corrosion and aging, and to delay the frost formation.

That is, conventionally, in the case of low FPI, a louver is provided at a corrugated portion in order to increase the heat exchange efficiency. However, this can be achieved without the louver as the area and overlapping length h1 of the corrugated portion is configured to satisfy a predetermined ratio corresponding to the area and length of the sheet portion 85.

FIG. 9 illustrates a heat exchanger with the fins of FIGS. 2 to 6 superimposed over one another.

Referring to FIG. 9, a plurality of fins 80 having the sheet portion 85 and the corrugated portion are placed on top of one another, and through-holes 89 are arranged to overlap each other.

As the heat transfer tube 60 is coupled by sequentially passing through the plurality of fins 80, one heat exchanger 40 may be defined.

Here, as described above, although the number of fins 80 is smaller than that of the related art, the air flow direction is facilitated without a louver, thereby achieving the heat exchange efficiency.

The heat exchanger of the preset disclosure has one or more of the following effects.

First, as the present disclosure has a structure including a through-hole through which a heat transfer tube passes, a corrugated portion formed in a zigzag shape in a first direction corresponding to an air flow direction, and a sheet portion configured as a flat surface adjacent to the through-hole, thereby facilitating the mixing of air in a region adjacent to the corrugated portion and the through-hole.

Second, by controlling an angle of a contact point, which is an air stagnation section between a sheet portion through which a through-hole passes and a corrugated portion, the mixing of air passing through the sheet portion and air passing through an inclined portion can be facilitated.

Third, as a coordinate of a contact point, which is the highest point of an inclined portion between the sheet portion and the corrugated portion, is limited within a predetermined range, the flow of air can be induced without causing stagnation to thereby improve the heat transfer performance.

Fourth, as air flow disturbance is facilitated at low fin per inch (FPI) while providing a flat corrugated portion without a louver fin, the fin material and process cost can be reduced. In addition, clogging by dust can be prevented by securing a space between fins. As no louver fin is provided, a heat exchanger that is robust against corrosion and aging and is advantageous in delaying the frost formation can be provided.

Fifth, as through-holes to which two columns of heat transfer tubes are coupled are arranged in a zigzag manner, air can be evenly or uniformly mixed in a direction perpendicular to an air flow direction without causing an air flow interference in the air flow direction by the heat transfer tube.

Although embodiments have been described with reference to a number of illustrative embodiments thereof, it should be understood that numerous other modifications and embodiments can be devised by those skilled in the art that will fall within the scope of the principles of this disclosure. Therefore, the above detailed description should not be construed as restrictive in all respects and should be considered as illustrative.

The present invention encompasses various modifications to each of the examples and embodiments discussed herein. According to the invention, one or more features described above in one embodiment or example can be equally applied to another embodiment or example described above. The features of one or more embodiments or examples described above can be combined into each of the embodiments or examples described above. Any full or partial combination of one or more embodiment or examples of the invention is also part of the invention.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A heat exchanger comprising:

a heat transfer tube configured to guide a refrigerant; and a plurality of fins spaced apart from each other to allow air to pass over the plurality of fins in a first direction, the plurality of fins extending in a second direction perpendicular to the first direction and being spaced apart in a third direction perpendicular to the first direction and the second direction, each of the plurality of fins including:

a through-hole through which the heat transfer tube is disposed;

a corrugated portion formed in a zigzag shape in the first direction;

a sheet portion surrounding the through-hole;

a connecting portion connecting the sheet portion to the corrugated portion;

an inclined contact point located at a highest position between the connecting portion and the corrugated portion measured in the third direction; and a valley portion contact point located at a lowest position between the connecting portion and the corrugated portion measured in the third direction, wherein the inclined contact point is located closer than the valley portion contact point, measured in the second direction, to an imaginary line extending in the first direction through a center of the through-hole, and wherein a distance measured in the second direction between the imaginary line and the inclined contact point is greater than or equal to a distance in the second direction between the imaginary line and the through-hole, and is less than or equal to a radius of the sheet portion.

2. The heat exchanger of claim 1, wherein each of the plurality of fins further includes a collar contacting the heat transfer tube, and wherein for each of the plurality of fins, the sheet portion is connected to an outer surface of the collar.

3. The heat exchanger of claim 1, wherein for each of the plurality of fins, the through-hole is a circle having a radius of a first size from a center of the heat transfer tube.

4. The heat exchanger of claim 3, wherein for each of the plurality of fins, the sheet portion is formed in a circular shape that is concentric with the through-hole, and wherein for each of the plurality of fins, the sheet portion has a radius of a second size greater than the first size.

5. The heat exchanger of claim 3, wherein for each of the plurality of fins, the connecting portion has an inclined surface that extends from the corrugated portion to a boundary line of the sheet portion.

6. The heat exchanger of claim 5, wherein for each of the plurality of fins, the corrugated portion includes a plurality of inclined portions, and wherein for each of the plurality of fins, the plurality of inclined portions have an inclination with respect to the first direction.

7. The heat exchanger of claim 6, wherein for each of the plurality of fins, the plurality of inclined portions includes two ridge portions and a valley portion.

8. The heat exchanger of claim 7, wherein the through-hole has a center overlapping each valley portion in the second direction.

9. The heat exchanger of claim 1, wherein for each of the plurality of fins, an inclination angle between the connecting portion and the sheet portion with respect to the inclined contact point is less than or equal to 145 degrees.

10. The heat exchanger of claim 9, wherein for each of the plurality of fins, the plurality of inclined portions includes two ridge portions and a valley portion, and wherein for each of the plurality of fins, the two ridge portions are positioned higher than or equal to the sheet portion in the third direction.

11. An air conditioner comprising:

an indoor heat exchanger configured to exchange heat with indoor air; and an outdoor heat exchanger configured to exchange heat with outdoor air, wherein at least one of the indoor heat exchanger or the outdoor heat exchanger comprises:

a heat transfer tube configured to guide a refrigerant; and a plurality of fins spaced apart from each other to allow air to pass over the plurality of fins in a first direction, the plurality of fins extending in a second direction perpendicular to the first direction and being spaced apart in a third direction perpendicular to the first direction and the second direction, each of the plurality of fins including:

a through-hole through which the heat transfer tube is disposed;

a corrugated portion formed in a zigzag shape in the first direction;

a sheet portion surrounding the through-hole;

a connecting portion connecting the sheet portion to the corrugated portion;

an inclined contact point located at a highest position between the connecting portion and the corrugated portion measured in the third direction; and a valley portion contact point located at a lowest position between the connecting portion and the corrugated portion measured in the third direction, wherein the inclined contact point is located closer than the valley portion contact point, measured in the second direction, to an imaginary line extending in the first direction through a center of the through-hole, and wherein a distance measured in the second direction between the imaginary line and the inclined contact point is greater than or equal to a distance in the second direction between the imaginary line and the through-hole, and is less than or equal to a radius of the sheet portion.

12. The air conditioner of claim 11, wherein the inclined contact point is located at a first distance from the sheet portion, and wherein the valley portion contact point is located at a second distance from the sheet portion, the second distance being shorter than the first distance.

13. The air conditioner of claim 11, wherein each of the plurality of fins further includes a collar contacting the heat transfer tube, and wherein for each of the plurality of fins, the sheet portion is connected to an outer surface of the collar.

14. The air conditioner of claim 13, wherein for each of the plurality of fins, the through-hole is a circle having a radius of a first size from a center of the heat transfer tube.

15. The air conditioner of claim 14, wherein for each of the plurality of fins, the sheet portion is formed in a circular shape that is concentric with the through-hole, and wherein for each of the plurality of fins, the sheet portion has a radius of a second size greater than the first size.

16. The air conditioner of claim 15, wherein for each of the plurality of fins, the connecting portion has an inclined surface that extends from the corrugated portion to a boundary line of the sheet portion.

17. The air conditioner of claim 16, wherein for each of the plurality of fins, the corrugated portion includes a plurality of inclined portions, and wherein for each of the plurality of fins, the plurality of inclined portions have an inclination with respect to the first direction.

18. The air conditioner of claim 17, wherein for each of the plurality of fins, the plurality of inclined portions includes two ridge portions and a valley portion.

19. The air conditioner of claim 18, wherein for each of the plurality of fins, the inclined contact point is positioned where each of the two ridge portions and the connecting portion meet, and wherein for each of the plurality of fins, an inclination angle between the connecting portion and the sheet portion with respect to the inclined contact point is less than or equal to 145 degrees.

* * * * *